US007837494B2

(12) United States Patent
Vich

(10) Patent No.: US 7,837,494 B2
(45) Date of Patent: Nov. 23, 2010

(54) CONNECTION OF WIRE TO A LEAD FRAME

(75) Inventor: Gaetan Vich, Goshen, IN (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 494 days.

(21) Appl. No.: 11/939,070

(22) Filed: Nov. 13, 2007

(65) Prior Publication Data

US 2008/0205020 A1 Aug. 28, 2008

Related U.S. Application Data

(60) Provisional application No. 60/891,597, filed on Feb. 26, 2007, provisional application No. 60/891,609, filed on Feb. 26, 2007.

(51) Int. Cl.
*H01R 13/00* (2006.01)

(52) U.S. Cl. ..... 439/427; 439/419; 439/421; 439/423

(58) Field of Classification Search ..... 439/419, 439/427–430, 421–425; 29/729, 827, 863, 29/865, 866

See application file for complete search history.

(56) References Cited

U.S. PATENT DOCUMENTS

| | | | | | |
|---|---|---|---|---|---|
| 1,117,650 | A * | 11/1914 | Erlanger | 439/425 |
| 2,799,841 | A * | 7/1957 | Macy | 439/423 |
| 3,631,298 | A * | 12/1971 | Davis | 361/809 |
| 3,715,457 | A * | 2/1973 | Teagno et al. | 174/88 R |
| 3,934,075 | A * | 1/1976 | Dilliplane | 174/75 R |
| 4,018,499 | A * | 4/1977 | Rickards | 439/396 |
| 4,971,564 | A * | 11/1990 | Meyer | 439/70 |
| 5,044,071 | A * | 9/1991 | Toda et al. | 29/827 |
| 5,133,673 | A * | 7/1992 | Dijkshoorn | 439/422 |
| 5,196,374 | A * | 3/1993 | Hundt et al. | 29/827 |
| 5,318,458 | A * | 6/1994 | Thorner | 439/427 |
| 5,656,847 | A * | 8/1997 | Okazaki et al. | 257/433 |
| 6,017,241 | A * | 1/2000 | Komai | 439/419 |
| 6,350,145 | B1 * | 2/2002 | Chen et al. | 439/422 |
| 6,350,146 | B1 * | 2/2002 | Su | 439/427 |
| 6,726,502 | B1 * | 4/2004 | Hayes | 439/422 |
| 7,217,012 | B2 * | 5/2007 | Southard et al. | 362/391 |
| 7,442,070 | B2 * | 10/2008 | Lee | 439/417 |

* cited by examiner

*Primary Examiner*—Neil Abrams

(57) ABSTRACT

An integrated circuit includes a first lead frame and a second lead frame that extend from an overmolded circuit assembly. Each of the lead frames includes a piercing portion to pierce through insulation on a corresponding electrical conduit. The piercing portion of the lead frames also provides a wrap around feature to mechanically secure the wire to the corresponding electrical conduit. In this manner, several processes can be eliminated and are not required for the desired mechanical and electrical connection of the integrated circuit lead frame to corresponding electrical conductors.

19 Claims, 6 Drawing Sheets

CONNECTION OF WIRE TO A LEAD FRAME

CROSS REFERENCE TO RELATED APPLICATION

The application claims priority to U.S. Provisional Application Nos. 60/891,597 and 60/891,609 both filed on Feb. 26, 2007.

BACKGROUND OF THE INVENTION

This invention generally relates to a method of attaching a wire to a lead frame. More particularly, this invention relates to a method and lead frame for attaching a wire to the lead frame without soldering or welding.

An integrated circuit typically includes stamped metal leads for providing a desired electrical connection. In a common configuration, a positive lead and a negative lead extend from an overmolded integrated circuit. The metal leads are utilized to provide the desired electrical connections to the integrated circuit. In some applications, it is desired to mount the integrated circuit in locations remote from a circuit board. In such applications, electrical communication is provided by wires that are soldered or welded to the corresponding leads. The soldering and welding process require additional process steps such as stripping the wires for example that add time and cost.

Accordingly, it is desirable to design and develop a process for attaching wires to metal leads that does not require welding or soldering.

SUMMARY OF THE INVENTION

A disclosed example lead frame includes a first lead and a second lead each including a piercing end. The piercing end comprises a point that is inserted into a perpendicular face of a wire to provide the desired electrical connection.

The example disclosed integrated circuit assembly includes a first lead frame and a second lead frame. With the first and second lead frames including a pointed piercing edge. This piercing edge provides the surface that allows the lead frame to be inserted into a face normal to the piercing ends such that a connection can be made between the wire and each of the lead frames without soldering welding or other secondary processes.

Another disclosed example includes a piercing end that is wrapped around a wire such that the piercing end not only pierces through the wire to provide the desired electrical connection but also surrounds the wire to provide a mechanical securing feature.

Another example wire connection element includes a clip with a knife edge that is inserted into the wire through the insulation to provide the electrical connection desired. The remaining portions of the clip secure the clip about the lead frame providing an electrical connection between the clip and the lead frame.

Accordingly, the example lead frame configuration provides the desired electrical communication to a wire without the requirements for additional processing such as welding and soldering.

These and other features of the present invention can be best understood from the following specification and drawings, the following of which is a brief description.

DETAILED DESCRIPTION OF THE EXAMPLE EMBODIMENT

Figure 1:
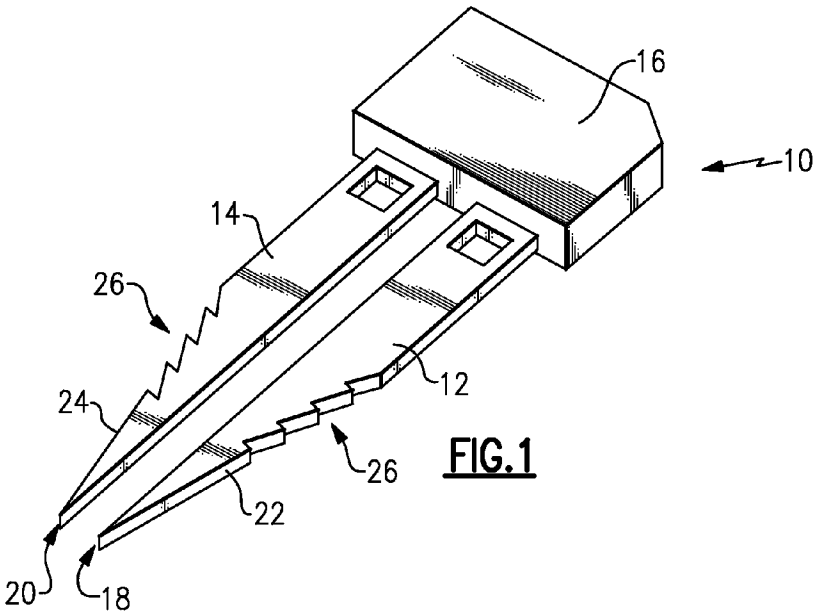
FIG. 1 is a perspective view of an example lead frame including the example piercing ends.
Figure 2:
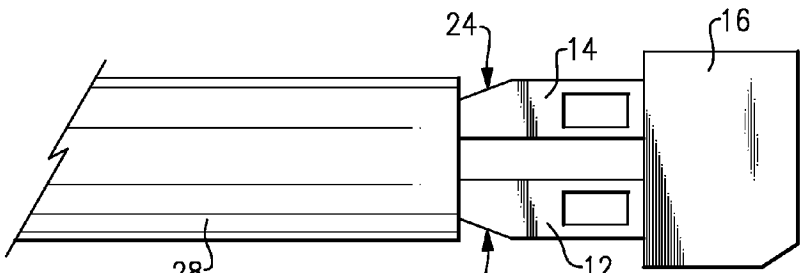
FIG. 2 is a side view of the example lead frames connected to a cable assembly.
Figure 3:
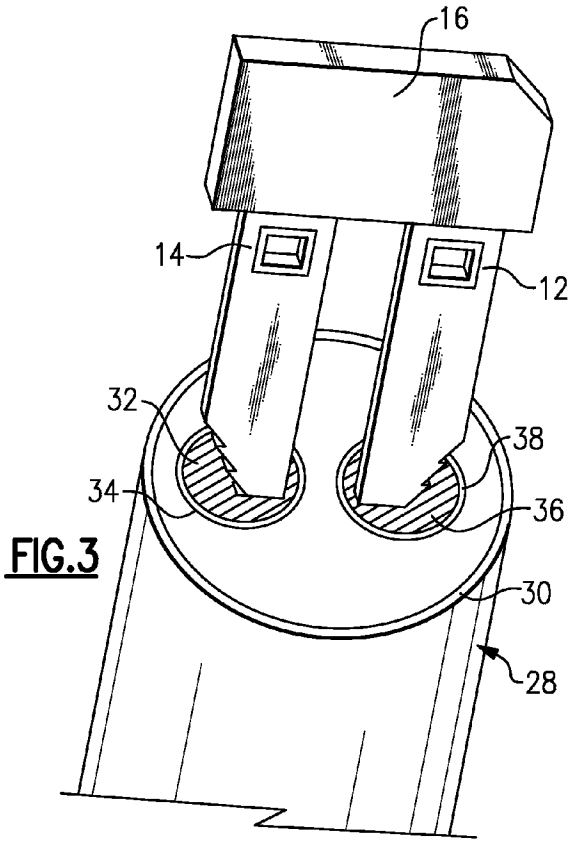
FIG. 3 is a perspective view of a face of the cable assembly with an integrated circuit lead frames attached to each of the corresponding wires.

Referring to FIGS. 1-3, an integrated circuit assembly 10 includes an integrated circuit 16 encapsulated to protect the circuit components therein. Extending outwardly from the encapsulated integrated circuit 16 is a first lead frame 12 and a second lead frame 14. The first and second lead frames 12, 14 are for attachment to an electrical conduit to provide electrical communication to the circuit assembly 16. Each of the first and second lead frames 12, 14 include corresponding piercing ends 18, 20. The piercing ends 18, 20 comprise a point that provides a sharp edge for insertion into a perpendicular face of an electrical conduit such as wires within a cable jacket.

The example piercing ends 18, 20 are formed at a terminal end of angled sides 22, 24. The angled sides 22, 24 taper from a greatest width of the corresponding lead frame 12, 14 to the ends 18, 20. The piercing ends 18, 20 are intended for insertion into a perpendicular face of a wire such as for example the wires 34, 36 that are assembled within a cable jacket 28. The wires 34, 36 are disposed adjacent each other and include in insulation layer 34, 38. The insulation layer 34, 38 surrounds each of the wires and provides a separation of electrical communication between the two wires 34, 36. The piercing ends 18, 20 are inserted into the wire face to provide the desired electrical communication between each of the wires and the circuit assembly 16. The example angled side portions 22, 24 can include serrated edges 26 to inhibit removal of the circuit assembly 10 once installed within the desired corresponding wire.

The example integrated circuit 10 includes the piercing ends 18, 20 on corresponding first and second leads 12 and 14 to allow for the simple insertion and electrical connection between separate electrical conductors such as the wires 36 and 34. This electrical connection is provided without the use of other processes such as welding, soldering, and further does not require stripping and removal of the insulation layers 34, 38. All that is required is that the face of the cable 28 be prepared to receive the piercing ends 18, 20. Once the circuit assembly 10 is inserted into the desired cable assembly 28, the entire cable assembly along with the circuit can be overmolded.

Figure 4:
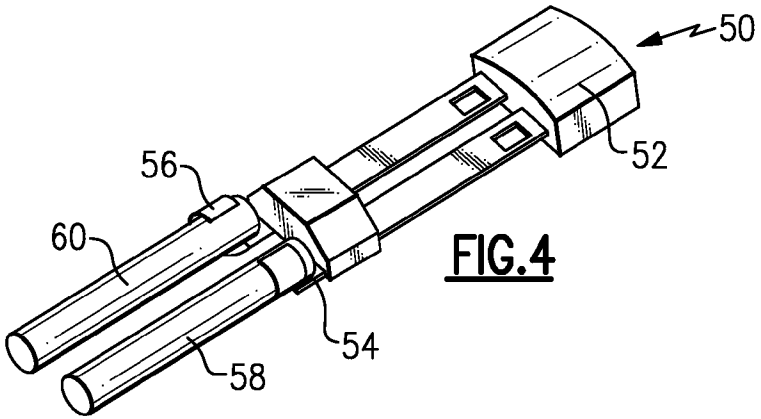
FIG. 4 is a perspective view of another example lead frame wire attachment configuration.

Referring to FIG. 4, another example circuit assembly 50 is shown and includes an overmolded integrated circuit 52 and first and second leads 54, 56. The leads 54, 56 extend from the integrated circuit 52 and include a portion for receiving and mechanically holding electrical wires 58, 60. The leads 54, 56 are selectively bent to provide a piercing function through the insulation of each of the wires 58, 60. The piercing connection process does not require stripping of insulation from the wires 58, 60. The leads 54, 56 extend through the insulation and into the electric conductive material of the wires 58, 60 to provide the desired electrical contact. The leads 54, 56 are also selectively bent to mechanically fasten the circuit assembly 52 to the accompanying wires 58, 60.

Figure 5:
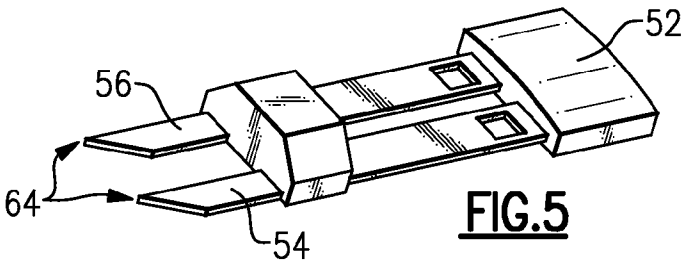
FIG. 5 is a perspective view of the example lead frame prior to insulation attachment to a wire.
Figure 6:
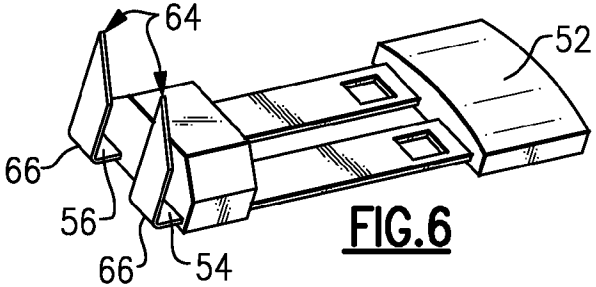
FIG. 6 is a perspective view of the lead frame including a piercing end that is bent in an initial manner.
Figure 7:
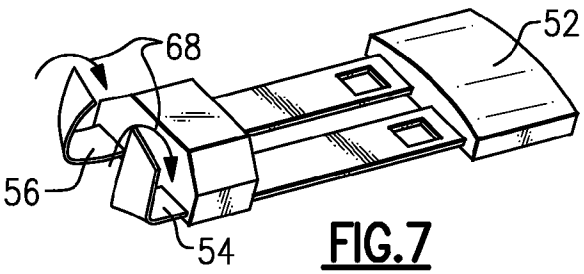
FIG. 7 is another perspective view of an example lead frame where each of the lead frames is bent in a final manner.

Referring to FIGS. 5, 6 and 7, the first and second leads 54 and 56 include piercing edges 64. The piercing edges 64 include a point that is provided by an angled surface that tapers from one side of each of the leads 54, 56 to the other. This tapered edge forms the piercing points utilized to extend through any insulation in the wires 58, 60. FIG. 5 illustrates the leads 54, 56 in an initial manner where the piercing edges 64 have been formed.

Referring to FIG. 6, the piercing edges 64 are bent upwardly within a first initial bend 66. This initial bend 66 points the piercing edge 64 upwardly in a perpendicular manner relative to the initial position of the leads 54, 56. This upward extension is the initial bend utilized to position the piercing edge 64 to receive the wires 58, 60.

Referring to FIG. 7, the upwardly bent portions of the first and second leads 54, 56 are then twisted such that the piercing edges 64 are disposed longitudinally relative to each of the first and second lead 54, 56. The twist bending positions the piercing point 64 and the tapered surface that is utilized to form that point in a longitudinal direction parallel with the direction of each of the wires 58, 60. Accordingly, the ends of each of the leads 54, 56 are disposed to point perpendicularly upward from each of the lead frames 54, 56 such that the piercing edges 64 extend upward with the tapered edge portion positioned longitudinally.

Each of the wires is then inserted beginning at the piercing edge 64 downwardly onto the corresponding lead 54, 56. The downward force drives the piercing edge 64 through the wire such that a portion of the corresponding lead 54, 56 extends entirely through the corresponding electrical conduit.

The portion of the lead 54, 56 that extends entirely through the corresponding electrical wires 58, 60 is then utilized to mechanically attach the wire in place. This mechanical attachment is provided by bending of the exposed portion of the lead around the wire.

Figure 8:
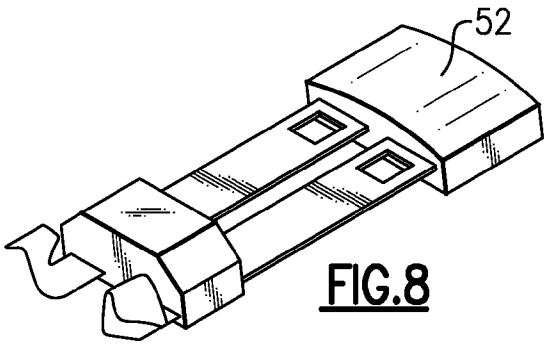
FIG. 8 is a perspective view of the example lead frame with the lead frames bent into the final configuration with the wire removed for clarity purposes.

Referring to FIG. 8, the final bend is illustrated without the electrical wire to show the piercing edge 64 wrapped around the wires 58, 60. In FIG. 8, the wires are removed to provide a clear view of the bending orientation of the corresponding leads.

Referring to FIGS. 9A-9F, example bending and assembly steps are schematically illustrated. Beginning with FIG. 9A, the piercing edge 64 is formed by tapering an edge surface of the corresponding conduit. The piercing edge 64 is then bent upwardly through an initial bend 68. This initial bend 68 positions the piercing edge 64 to extend transversely or perpendicular to the remainder of the corresponding lead frame 54, 56.

Figure 9A:
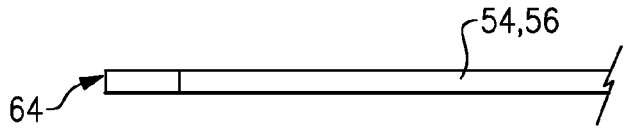
FIGS. 9A-9F are side views of the example steps performed to attach a wire to the example lead frame.
Figure 9B:
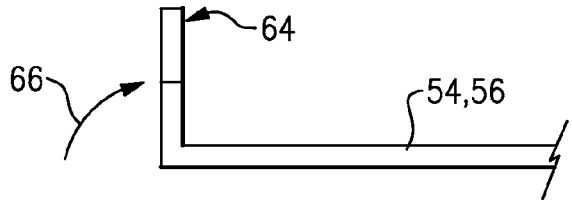
Figure 9C:
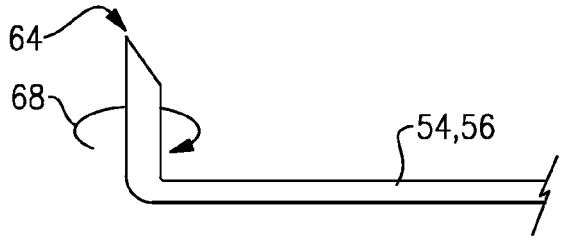

Referring to FIG. 9C, the upward extending portion of the lead frame 54, 56 including the piercing edge 64 is then twisted by rotating it clockwise or counter-clockwise to position the tapered surface and piercing edge 64 longitudinally along the same direction as the lead frames. This twisting bend places the tapered portion and piercing edge 64 in a longitudinal orientation substantially centered along each of the corresponding lead frames 54, 56. In this position the lead frames 54, 56 are prepared to receive a wire for the connection and electrical attachment to the corresponding lead frame 54, 56.

Figure 9D:
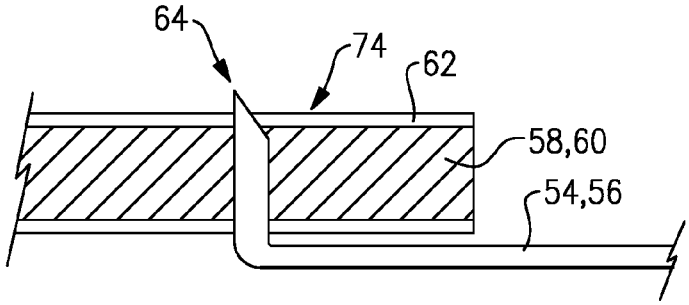

Referring to FIG. 9D, a wire 58, 60 is inserted over the upwardly extending portion of the lead frame 54, 56 such that the piercing edge 64 extends entirely through the corresponding wire conduit 58, 60. The insulation 62 for each wire 58, 60 is left on as the piercing edge 64 extends not only through the insulation but through the electrical conductive material. The piercing edge 64 along with a portion of the upward extending through part of the lead frame 54,56 extends upwardly above the corresponding wire 58,60 to provide material for mechanically attaching and securing the wire 58,60 to the lead frame 54,56.

Figure 9E:
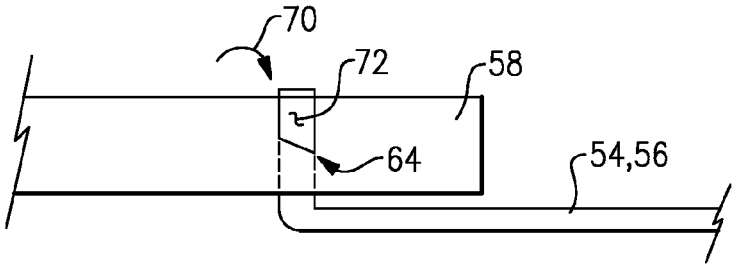

Referring to FIG. 9E, the upward extending portion 72 is bent downwardly over and around the wire 58, 60 along a bend 70. This wrapping of the portion 72 provides a mechanical attachment required to secure the wires 58 and 60 to the lead frame 54, 56.

Figure 9F:
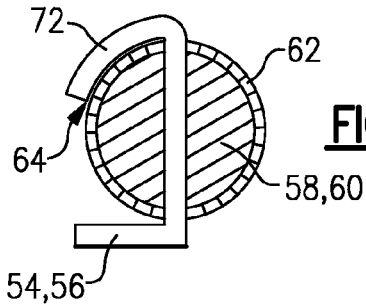

Referring to FIG. 9F, a cross-sectional view of the completed connection is shown that includes the lead frame 54, 56 along with the upward extended portion 72 that is wrapped around the corresponding wire 58, 60. As is shown, the portion 72 wraps only about one portion of the wire 58, 60 to trap and mechanically secure the wire 58, 60. As appreciated, the length of the wrap around portion 72 can be modified to overlap the wire 58, 60 to provide more or less mechanical attachment as is desired.

Figure 10:
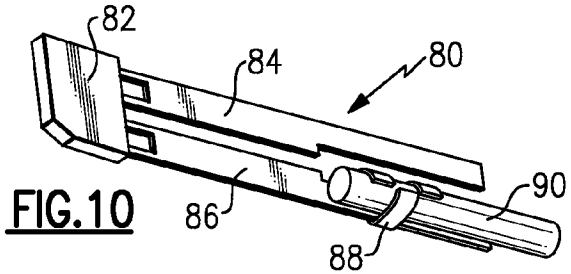
FIG. 10 is a perspective view of another wire lead frame connection.
Figure 11:
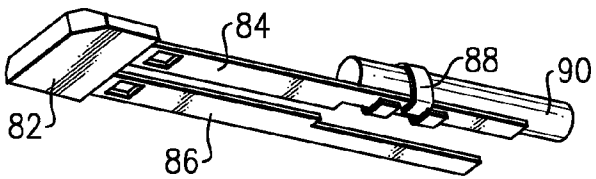
FIG. 11 is a perspective view of a bottom portion of the example lead frame connection.

Referring to FIGS. 10 and 11, another example attachment assembly 80 includes a clip 88 that is attached to a corresponding one of the lead frames 84, 86 extending from an encapsulated circuit assembly 82. In this example, the clip 88 is inserted through conductive material of the wire 90 and clamped to the corresponding one of the lead frames 84, 86.

Figure 12:
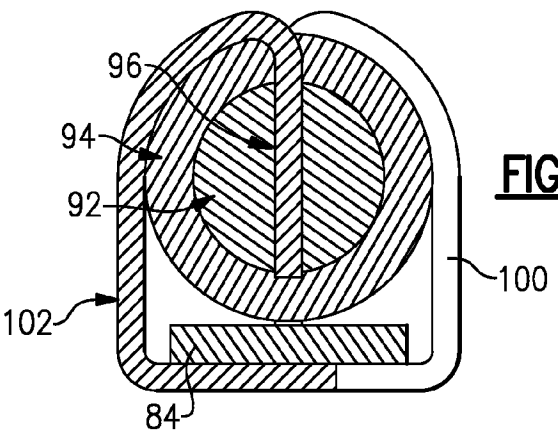
FIG. 12 is a cross-sectional view of the example clip installed to the lead frame and inserted into the example wire.

Referring to FIG. 12, a piercing portion 96 of the clip 88 extends through the wire insulation 94 into the electrically conductive material 92. The clip 88 is then secured to a portion of the corresponding lead frame 84. The clip 88 includes clamp portions along with the piercing portion 96 that is inserted through the insulation 94 and into the electrical conductive material 92 of the wire 90. Another clamp portion supports the piercing portion 96 and wraps about the corresponding lead frame 84, 86.

Figure 13:
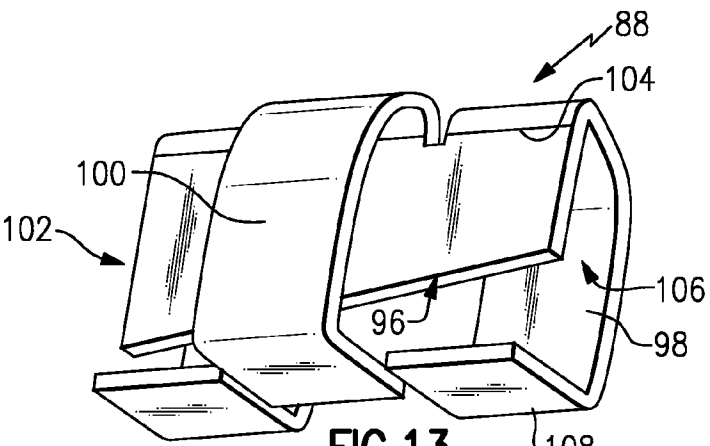
FIG. 13 is a perspective view of an example clip for attaching and electrically communicating a wire to a lead frame.
Figure 14:
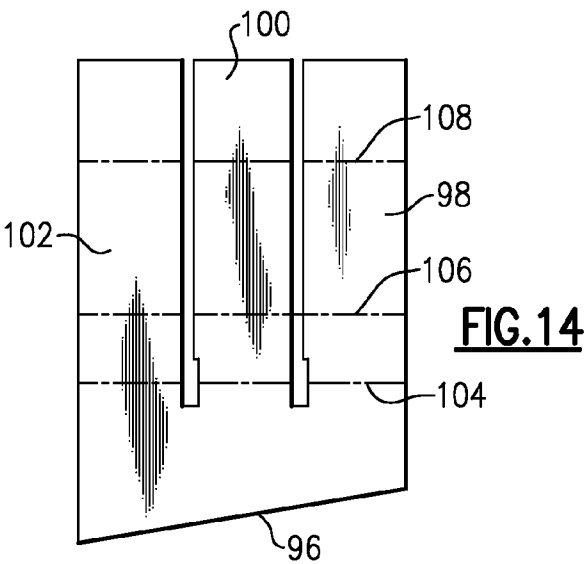
FIG. 14 is a plan view of the example clip prior to bending.

Referring to FIGS. 13 and 14, the clip 88 includes legs 98, 100, 102. The legs 98, 100, and 102 are selectively bent from a flat sheet of material illustrated in FIG. 14. The clip 88 begins as a flat sheet of material with the legs 98, 100, 102. The legs 98,100, 102 are bent along bend lines 104, 106, and 108 to provide the desired configuration of the clip assembly 88. The clip assembly 88 includes the piercing surface 96 that pierces through the wire insulation and into the electrical conductor 92.

Figure 15:
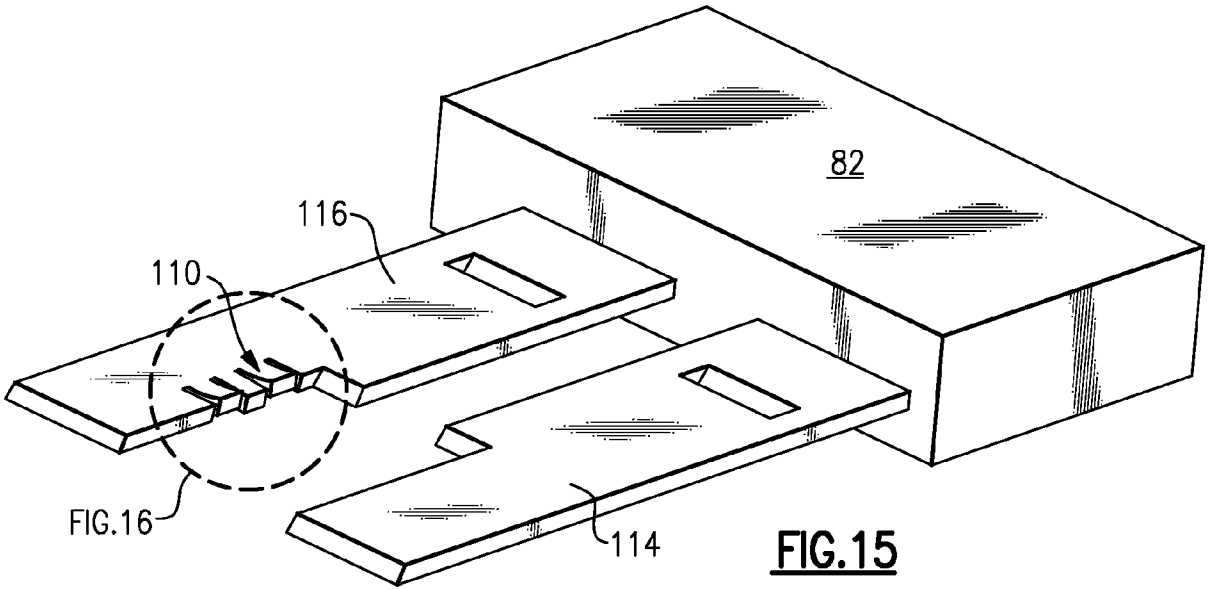
FIG. 15 is a perspective view of a portion of the lead frame configured to receive the example clip.
Figure 16:
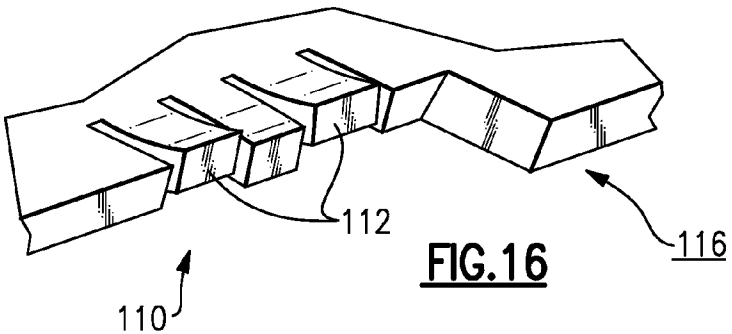
FIG. 16 is an enlarged view of the area of the lead frame configured to receive the example clip.

Referring to FIGS. 15 and 16, the example integrated circuit assembly 82 includes the leads 116 and 114. The leads 116 and 114 include a specific surface designed to engage a portion of the example clip 88. The surface 110 includes a plurality of teeth 112. The teeth 112 extend from a planar surface to provide a rough edge. This edge is locked into securing legs 98,100,102 of the clip 88 to provide a desired interference fit that aids in maintaining the clip 88 on the corresponding one of the lead frames 116,114.

Figure 17:
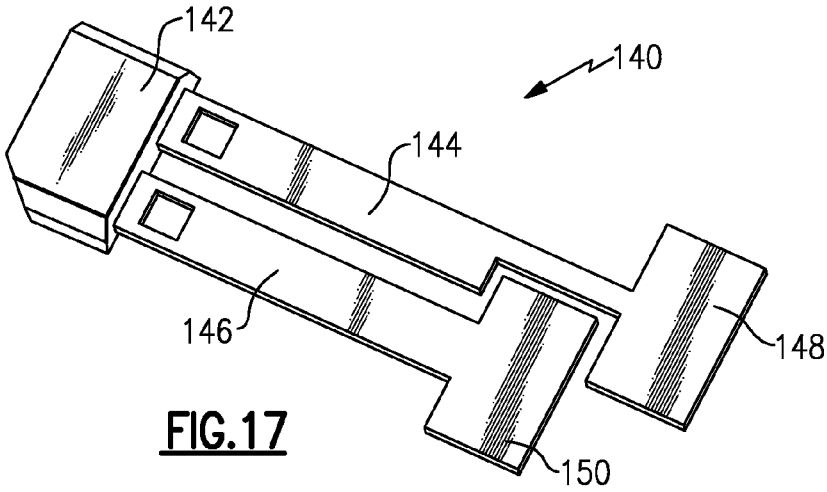
FIG. 17 is another example lead frame including crimped portions disposed on each lead frame.
Figure 18:
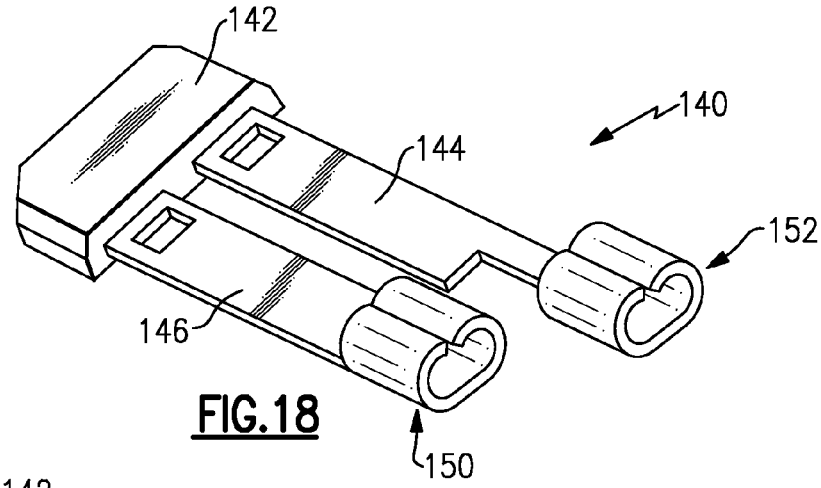
FIG. 18 is an example lead frame including the crimped portions formed in a pre-crimped manner.
Figure 19:
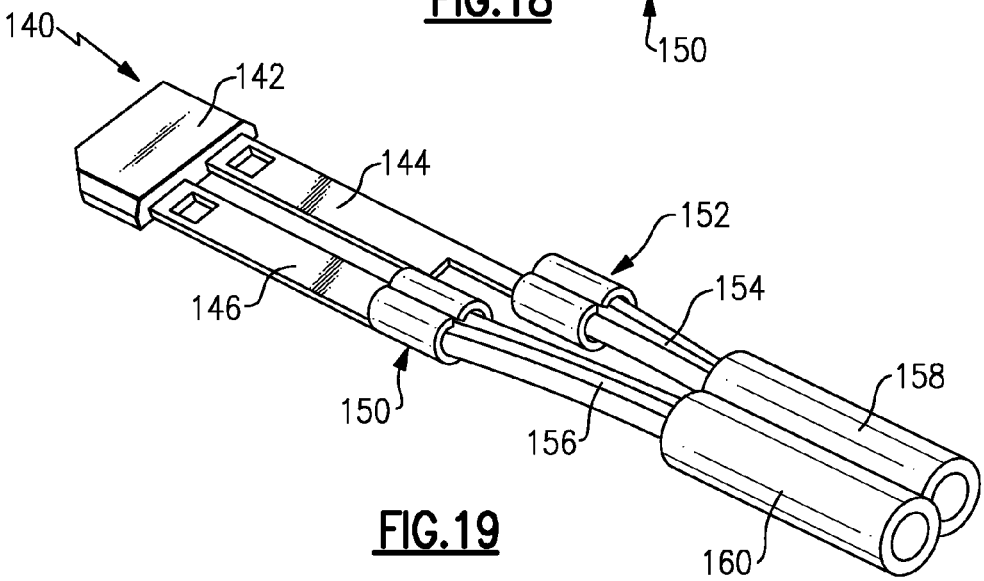
FIG. 19 is a perspective view illustrating wire connections to the crimped portions.

Referring to FIGS. 17, 18 and 19, another example integrated circuit assembly 140 includes an integrated circuit 142 overmolded with leads 144 and 146 extending there from. Each of the leads 144 and 146 include corresponding crimp pads 148 and 150. Each of the crimped pads is offset from each other to prevent a short between the corresponding leads 144,146. The crimp pads 148 and 150 include a larger width and additional material than the remainder of the corresponding leads 144, 146.

The example pads 148 and 150 are crimped onto each other to form crimp configurations 150,152. FIG. 18 showed the finish crimp without electrical conduits 158, 160 for clarity. The electrical conduit 158,160 is inserted into the opening provided by the rolled over portions of the crimp configurations 150, 152. FIG. 19 shows the wires 158, 160 inserted into the corresponding crimp configurations 150,152, with the crimp pressed inwardly to engage and secure the wire to the leads 144,146.

Accordingly, the example integrated circuit lead frame assemblies disclosed in this application provide different mechanical means of both securing and providing the desired electrical connection without requiring additional processes such as welding and soldering. Further, several of the disclosed examples electrical connection without removal of any corresponding insulation.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An integrated circuit assembly comprising:
a circuit overmolded to protect elements of the circuit;
a first lead extending from the circuit including a first pointed end; and
a second lead extending from the circuit including a second pointed end, wherein the first pointed end and the second pointed end include a length determined to extend through a corresponding pierced wire, wherein said length wraps at least partially around the corresponding pierced wire.

2. A method of attaching a wire to a lead frame comprising the steps of:
forming a piercing end on a first end of a lead frame;
piercing a wire with the piercing end to provide an electrically conductive connection between the wire and the lead frame;
extending the first end completely through the pierced wire; and
wrapping the first end at least partially about an outer surface of the pierced wire for securing the pierced wire to the lead frame.

3. The method as recited in claim 2, including the step of bending the piercing portion relative to other portions of the lead frame.

4. The method as recited in claim 2, wherein the piercing portion is disposed on a clip separate from the lead frame.

5. The method as recited in claim 4, including legs attached to the piercing portion and the step of wrapping the legs about the wire and the lead frame.

6. The method as recited in claim 5, including the step of forming the piercing portion and legs from a piece of sheet metal.

7. The method as recited in claim 2, including cutting material from the lead frame to form a pointed tip on the piercing end.

8. The method as recited in claim 2, including piercing a face of the wire with the piercing end where the face of the wire us perpendicular to a length of the wire.

9. The method as recited in claim 2, including piercing a longitudinal surface of the wire with the piercing end.

10. A lead frame for an integrated circuit comprising:
a first lead including a first pointed end for piercing a face of a first electrical conduit; and
a second lead including a second pointed end for piercing a face of second electrical conduit, wherein the faces of the first and second electrical conduits comprises a terminal end surface of each of the first and second electrical conduits.

11. The lead frame as recited in claim 10, wherein the first lead and the second lead comprises a rectangular metal strip.

12. The lead frame as recited in claim 10, wherein the first pointed end and the second pointed end comprise one angled side on each of the first lead and the second lead.

13. The lead frame as recited in claim 11, where the angled sides of the first and second leads are disposed on a side opposite the other of the first and second lead.

14. The lead frame as recited in claim 12, including serrations on each of the angled sides of the first and second leads.

15. An integrated circuit assembly comprising:
a circuit overmolded to protect elements of the circuit;
a first lead extending from the circuit including a first pointed end comprising an angular side extending across a width of the first lead; and
a second lead extending from the circuit including a second pointed end comprising an angular side extending across a width of the second lead.

16. The assembly as recited in claim 15, wherein each of the angular sides include serrations.

17. The assembly as recited in claim 15, wherein the first pointed end and the second pointed end include a length that extends through a pierced wire that is wrapped about an outer surface of the pierced wire for holding the pierced wire to the corresponding lead.

18. An integrated circuit assembly comprising:
a circuit disposed within an overmolding material;
a first lead extending from the circuit within the overmolded material, the first lead including a first crimp pad formable to form an electrical connection to an electrical conduit; and
a second lead extending from circuit within the overmolded material, the second lead including a second crimp pad formable to from an electrical connection to an electrical conduit, the second crimp pad spaced a distance from the circuit different than a distance of the first crimp pad from the circuit.

19. The assembly as recited in claim 18, wherein each of the first crimp pad and the second crimp pad comprise a width greater than the corresponding first lead and the second lead.

* * * * *